US005357486A

United States Patent [19]

Pearce

[11] Patent Number: 5,357,486

[45] Date of Patent: Oct. 18, 1994

[54] ACOUSTIC TRANSDUCER

[75] Inventor: Richard E. Pearce, Ft. Worth, Tex.

[73] Assignee: Innovative Transducers Inc., Haltom City, Tex.

[21] Appl. No.: 989,372

[22] Filed: Dec. 2, 1992

[51] Int. Cl.[5] ..... H04R 17/00

[52] U.S. Cl. ..... 367/159; 367/157; 367/169; 181/105; 181/106; 181/110; 310/334; 310/337; 310/800

[58] Field of Search ..... 367/159, 157, 163, 166, 367/912, 169; 181/105, 106, 110; 310/337, 334, 800

[56] References Cited

U.S. PATENT DOCUMENTS

| | | | |
|---|---|---|---|
| 4,134,097 | 1/1979 | Cowles | 367/159 |
| 4,653,036 | 3/1987 | Harris et al. | 367/170 |
| 4,674,067 | 6/1987 | Zemanek, Jr. | 367/25 |
| 4,756,192 | 7/1988 | Heine et al. | 73/632 |
| 4,809,244 | 2/1989 | Penneck et al. | 367/162 |
| 4,810,913 | 3/1989 | Beauducel et al. | 310/337 |
| 4,841,192 | 6/1989 | Tetlie et al. | 310/337 |
| 4,918,666 | 4/1990 | Beauducel et al. | 367/15 |
| 4,984,222 | 1/1991 | Beauducel et al. | 367/159 |
| 5,130,953 | 7/1992 | Grosso | 367/155 |

*Primary Examiner*—J. Woodrow Eldred
*Attorney, Agent, or Firm*—William A. Knox

[57] ABSTRACT

A piezoelectric film strip is wrapped a plurality of times around a flexible inert mandrel that has standoff collars on each end. The film-wrapped mandrel is hermetically sealed inside a hollow rigid inert cylinder. Electrodes provide electrical communication with the film strip which forms the active element of the transducer. Variations in hydrodynamic pressure flex the film strip in tension to generate a voltage.

10 Claims, 1 Drawing Sheet

ACOUSTIC TRANSDUCER

BACKGROUND OF THE INVENTION

1. Field of the Invention

This invention is concerned with piezoelectric transducers for use in borehole logging, seismic exploration and similar research.

2. Discussion of Related Art

Piezoelectric transducers are well known for use in seismic exploration and borehole logging. The transducers may be designed to act as either a transmitter or a receiver or, perhaps, the same unit may be used for both purposes in alternate cycles. Typically, piezoelectric transducers employ ceramic materials such as barium titanate or lead zirconate titanate. The units may be polarized to operate in the bender mode or in the radial mode depending upon the desired use. The sensitive element may be a thin wafer backed by a metal diaphragm, a right cylinder or a flat slab mounted on an inert plate that is supported from one or both ends. Ceramic material is brittle and, in the presence of a shock wave as from a nearby air gun, a ceramic element may shatter.

Another class of piezoelectric material is polyvinylidine flouride (PVDF) which is a polymer film that is known by the trade name of KYNAR made by Atochem, a Division of Elf Aquataine, of Valley Forge, Pa. This film is preferred by some workers in the art because its acoustic impedance is close to that of water so that acoustic wavefields do not suffer spurious reflections from that material as they do when encountering a ceramic element. The signal strength is much higher than can be obtained from ceramic devices of similar physical size. The film is flexible and very strong so that a PVDF transducer is more rugged than a ceramic transducer.

Prior to use, the film must be poled in the thickness direction by soaking it in an electric field such as 20 volts/mil at an elevated temperature such as 200° for a period of time such as 2000 seconds. The opposite sides of the film are metallized by evaporating thereon a thin conductive coating, a few microns thick, of metallic silver or silver ink. Other metals such as gold may also be used. Electrodes are bonded to the metallized backing on the opposite sides of the piezoelectric film for electrical communication with the outside world. An external force applied to the film results in a tensile strain or a compressive stress. In response to the stress/-strain, the film develops a proportional open circuit voltage, that is, an electrical charge in proportion to changes in the applied mechanical force. The charge leaks away as a function of time depending upon the dielectric constant of the film and the impedance of the connected circuitry. By convention, the polarization axis is in the thickness direction. Tensile forces may be applied along either the longitudinal or the transverse axis.

U.S. Pat. No. 4,653,036, issued Mar. 24, 1987 to G. R. Harris et al teaches a hydrophone device that includes a piezoelectrically active sheet stretched and clamped over the top of a hoop ring. A backing is attached to the back of the hoop ring. A low dielectric material fills the space between the backing and the sheet. This material eliminates the capacitative loading effect which would otherwise be presented by the medium being probed.

Another acoustic wave sensor is described in U.S. Pat. No. 4,756,192, issued Jul. 12, 1988, to G. Heine et al. The shock wave sensor includes a piezoelectric foil that is either suspended in a ring or on a backing. Electrodes run from a particular sensitive area on the foil towards the edges and are fracture-proof connected to concentric conductors.

C. Bauducel et al, in U.S. Pat. No. 4,810,913, which issued Mar. 7, 1989, discloses a hydrophone that is provided having at least one flexible piezoelectric sensitive element applied to a support. Each sensitive element is formed of a flexible piezoelectric film associated with two electrodes and is applied to a synthetic plastic material support one face at least of which has hollow parts of very different shapes, for example a homogeneous distribution of cups, honeycombs, holes etc. whose dimensions are determined as a function of the mechanical characteristics of the films used. The stresses applied thereto result in deforming each film inwardly of the hollow parts which very greatly increases the sensitivity.

In this disclosure, the term "hydrostatic pressure" refers to the static pressure due to a fluid column of some particular height. The term "hydrodynamic pressure" refers to the cyclic pressure differences that are created by acoustic waves propagating through a fluid.

This invention in intended to fill a need for a rugged acoustic transducer that is simple in design and economical to manufacture.

SUMMARY OF THE INVENTION

The transducer of this invention includes a rigid inert hollow cylindrical member that has interior and exterior surfaces. A polarized piezoelectric film strip, the opposite sides of which have a metallized backing, is wrapped a number of times around a flexible mandrel that has upset end portions, the film strip being positioned between the upset portions. The film-wrapped mandrel is inserted inside the hollow cylinder. The upset end portions are hermetically sealed to the interior surface of the hollow cylinder. The upset end portions are dimensioned such that there is a void between the outermost wrap of the piezoelectric film and the interior surface of the hollow cylinder. The void is filled with a desired gas under a preselected initial pressure. External electrodes are bonded to the metallized conductive backings on opposite sides of the film.

BRIEF DESCRIPTION OF THE DRAWINGS

The novel features which are believed to be characteristic of the invention, both as to organization and methods of operation, together with the objects and advantages thereof, will be better understood from the following detailed description and the drawings wherein the invention is illustrated by way of example for the purpose of illustration and description only and are not intended as a definition of the limits of the invention.

DETAILED DESCRIPTION OF THE PREFERRED EMBODIMENT

Figure 1:
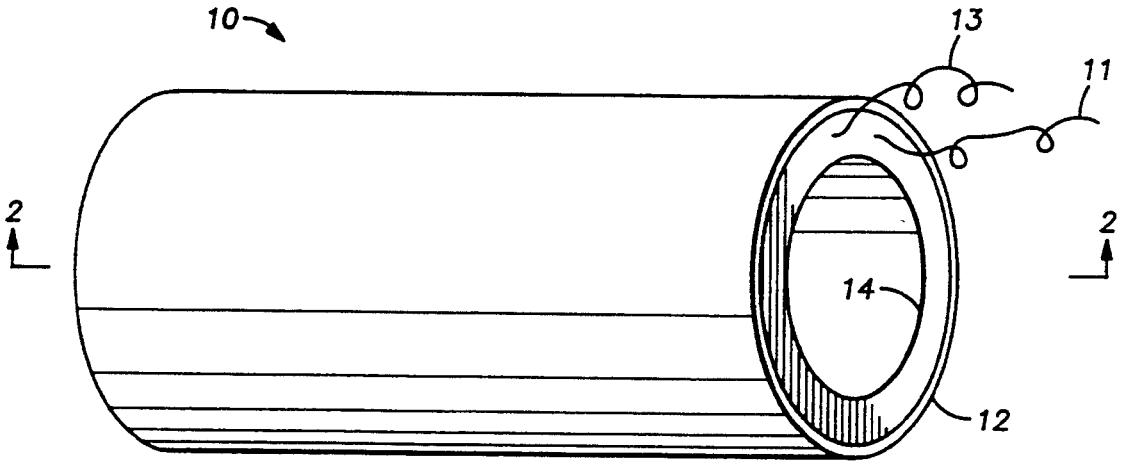
FIG. 1 is an external isometric view of the transducer of this invention.

FIG. 1 is an external isometric view of the transducer 10 of this invention. It is preferably of hollow cylindrical shape although it could be of some other shape if desired. The prototype model is about one inch in diameter and about two inches long although it may be larger or smaller as needed to accommodate the device to specific needs. FIG. 3 is an end view of the configuration of FIG. 1. Transducer 10 consists essentially of an outer rigid cylindrical member 12, inside of which is mounted an active element which takes the form of a hollow mandrel 14 as will be described in more detail in connection with FIG. 2. Electrodes 11 and 13 conduct signals to or from the transducer 10 depending upon its application to serve as a transmitter or as a receiver.

Figure 2:
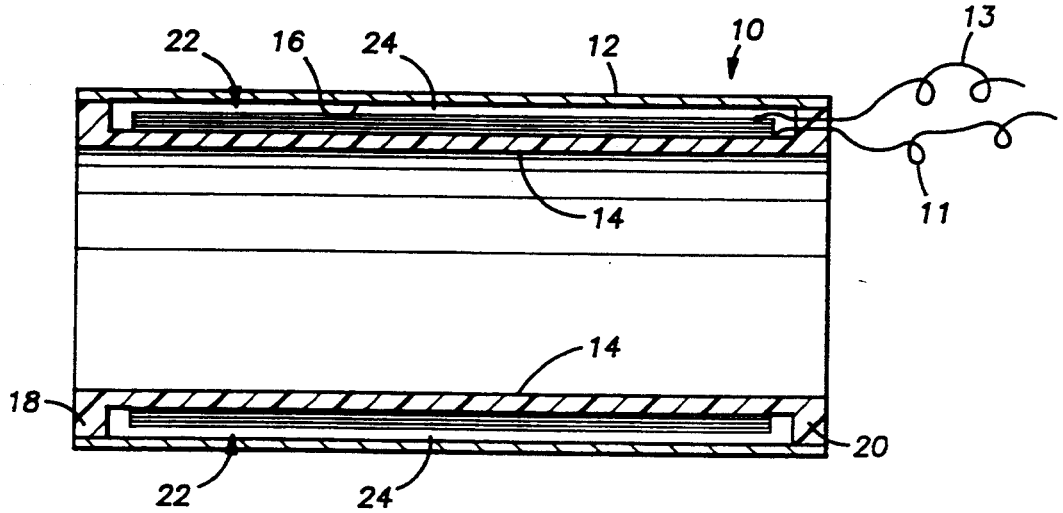
FIG. 2 is a cross section along line 2—2 of FIG. 1.
Figure 3:
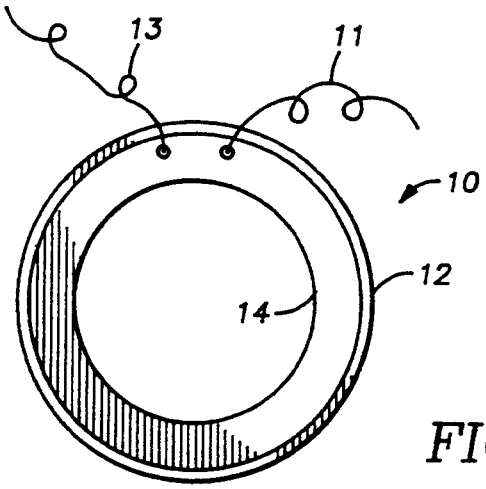
FIG. 3 is an end view of FIG. 1.

In FIG. 2, which is a cross section along lines 2—2 of FIG. 1, there is shown an outer rigid hollow inert member 12, having an inner surface 16. Member 12 may be made of thin-walled aluminum tubing, stainless steel, rigid tough plastic or any other suitable material. Mandrel 14 is made of a relatively flexible substance such as polyurethane, neoprene or any other product that can be injection molded or machined. On each end of mandrel 14, there is formed an upset or raised boss 18 and 20. The active transducer element is formed from a plurality of turns or wraps of a continuous strip of polarized piezoelectric film indicated generally as 22, that are wrapped around mandrel 14 between the upset end portions 18 and 20. Preferably, the film may be about 20 mils thick. As is customary, the opposite sides of the PVDF piezoelectric film are metallized with a conductive coating although the metallization is not shown in the drawing since it is only a few microns thick. A non-conductive coating may be applied over the metallizing material to prevent electrical short-circuiting between the respective wraps. Electrodes 11 and 13 are bonded to the conductive coating on each of the opposite sides of the film and emerge from the end of the mandrel through sealed portals as shown to provide electrical communication with the active transducer element.

After the respective turns 22 of the piezoelectric film have been wrapped around mandrel 14 and secured in place against uncoiling, the assembly is inserted into rigid cylinder 12 where the upset end portions or bosses 18 and 20 are hermetically sealed to the interior surface 16 of hollow cylinder 12. Preferably, a non-conductive epoxy cement is used as a means for sealingly securing the mandrel to the interior of hollow cylinder 12. The upset portions or raised bosses 18 and 20 of mandrel 14 serve as standoffs relative to the interior wall of rigid cylinder 12 and are dimensioned so that a void or space 24 is formed between the outermost wrap of the piezoelectric film and the interior surface of rigid cylinder 12. The space 24 is preferably filled with a desired gas such as air or dry nitrogen under some initial pressure such as may have existed at the time of manufacture, ambient atmospheric pressure for example. The clearance between the outermost layer of the piezoelectric film and the interior surface 16 of cylinder 12 may be on the order of 0.031 to 0.125 inch.

In operation as a receiver, an increase in hydrodynamic pressure causes flexible mandrel 14 to bulge outwardly towards interior wall 16 of cylinder 12. That action necessarily stretches the piezoelectric film strip 22 that is wrapped around the mandrel, thus applying a longitudinal strain thereto to generate an open circuit voltage. The voltage generated is proportional to the applied strain as a function of time. The volume of gas that is resident in void 24 acts as a restoring spring against which flexible mandrel 14 reacts and provides a means for hydrostatic pressure equalization.

In operation as a transmitter, a voltage spike or chirp signal is applied to the active element. The voltage spike or chirp signal causes the active element to snap in a direction corresponding to the polarity of applied voltage, thereby generating a pressure transient in the surrounding medium.

As pointed out in the previous paragraph, an applied pressure transient, from whatever cause, results in an outward bulging of the flexible mandrel and a longitudinal stretching or expansion the piezoelectric film strip. The design is such that the film expansion will not exceed the yield strength of the film. That is an advantage because upon release of the applied pressure, the piezoelectric film returns to its original relaxed state without hysteresis.

Another type of piezoelectric-film transducer is known wherein the film strip is wrapped around the outside of a mandrel in a confined space. The mandrel has a dished-in outer surface. Application of static pressure at operating depth inwardly compresses the film strip with a consequent reduction in diameter of the film-wraps within the confined space. The film necessarily tends to crumble and become wrinkled, the electrical output is diminished and the film tends not to recover to its original state upon release of the static pressure. That is at least one of the problems that the present invention is intended to overcome.

This invention has been disclosed with a certain degree of specificity by way of example but not by way of limitation. For example, the transducer has been described by way of example with respect its use in a hydrodynamic environment, implying use under water. The transducer can, of course be used in conjunction with any acoustic-propagation medium that is capable of coupling an acoustic wavefield with the active element of the transducer. Although wire electrodes are shown that sealingly pass through an end portion of mandrel 14, miniature inductive pickups could be used to avoid penetration of an end portion, thereby improving the hermetic sealing integrity of the assembly.

What is claimed is:

1. An acoustic transducer, comprising:

a rigid inert cylindrical member having inner and outer wall surfaces;

a flexible inert mandrel having opposite upset end portions;

an active transducer element formed from a piezoelectric film strip wrapped a plurality of times around said inert mandrel; and means for sealingly securing said opposite upset end portions of said flexible inert mandrel to the inner surface of said rigid inert cylindrical member.

2. The transducer as defined by claim 1, wherein:

the opposite upset end portions are dimensioned to provide a void between the outermost wrap of the piezoelectric film and the inner surface of the cylindrical member.

3. The transducer as defined by claim 2, comprising:

a volume of a desired gas filling said void.

4. The transducer as defined by claim 3, wherein:

said volume of gas is under a preselected initial pressure.

5. The transducer as defined by claim 1, comprising:

means for establishing electrical communication with said active transducer element.

6. An acoustic transducer, comprising:

a rigid inert hollow cylinder;

a flexible inert mandrel having a raised boss at each end thereof;

a plurality of turns of a piezoelectric film strip wrapped around said flexible mandrel between said raised bosses; and means for hermetically sealing the respective raised bosses to the interior of said hollow cylinder.

7. The acoustic transducer as defined by claim 6, comprising:

a conductive coating applied to the opposite sides of said piezoelectric film strip; and an insulating coating covering said conductive coating.

8. The transducer as defined by claim 6, wherein:

the bosses are dimensioned to provide a sealed compartment between the outermost turn of the piezoelectric film strip and the hollow cylinder.

9. The transducer as defined by claim 8, comprising:

a volume of a preselected gas filling said sealed compartment under a predetermined initial static pressure.

10. The transducer as defined by claim 7, comprising:

externally accessible electrode means bonded to the conductive coatings on the opposite sides of the piezoelectric film strip.

* * * * *